United States Patent [19]

Friesen et al.

[11] 4,288,997

[45] Sep. 15, 1981

[54] COOLING SYSTEM FOR SHIPPING CASKS

[75] Inventors: Eckart Friesen, Dreieich; Hans P. Thøgersen; Roland Kühnel, both of Dietzenbach, all of Fed. Rep. of Germany

[73] Assignee: Kraftwerk Union Aktiengesellschaft, Mülheim (Ruhr), Fed. Rep. of Germany

[21] Appl. No.: 26,524

[22] Filed: Apr. 3, 1979

[30] Foreign Application Priority Data

May 4, 1978 [DE] Fed. Rep. of Germany ..... 2814796

[51] Int. Cl.³ ..... F25D 17/02

[52] U.S. Cl. ..... 62/434; 62/299; 62/304; 165/60; 176/37; 176/38; 250/506

[58] Field of Search ..... 62/430, 434, 299, 304; 165/60, 107; 176/37, 38; 250/506, 507

[56] References Cited

U.S. PATENT DOCUMENTS

| | | | |
|---|---|---|---|
| 2,030,032 | 2/1936 | Keyes | 62/434 |
| 2,125,261 | 7/1938 | Stern | 62/299 |
| 2,164,761 | 7/1939 | Ashley | 62/434 |
| 2,213,421 | 9/1940 | Wagner, Jr. | 62/434 |
| 2,737,031 | 3/1956 | Wulle | 62/434 |
| 2,746,272 | 5/1956 | Carpenter | 62/434 |
| 3,222,255 | 12/1965 | Maldague | 176/37 |
| 3,284,311 | 11/1966 | McHugh | 176/65 |
| 3,722,578 | 3/1973 | Frei et al. | 165/60 |
| 3,962,587 | 6/1976 | Dufrane et al. | 250/506 |

*Primary Examiner*—Ronald C. Capossela
*Attorney, Agent, or Firm*—Herbert L. Lerner

[57] ABSTRACT

Cooling system for containers for transporting heat-emitting parts from nuclear installations, including a closed loop connected to the container for carrying water and steam or water alone, the loop having disposed therein a heatable mixing condenser, a filter installation, a cooler, a pump, and valve-control means for controlling pressure and temperature in the loop.

4 Claims, 1 Drawing Figure

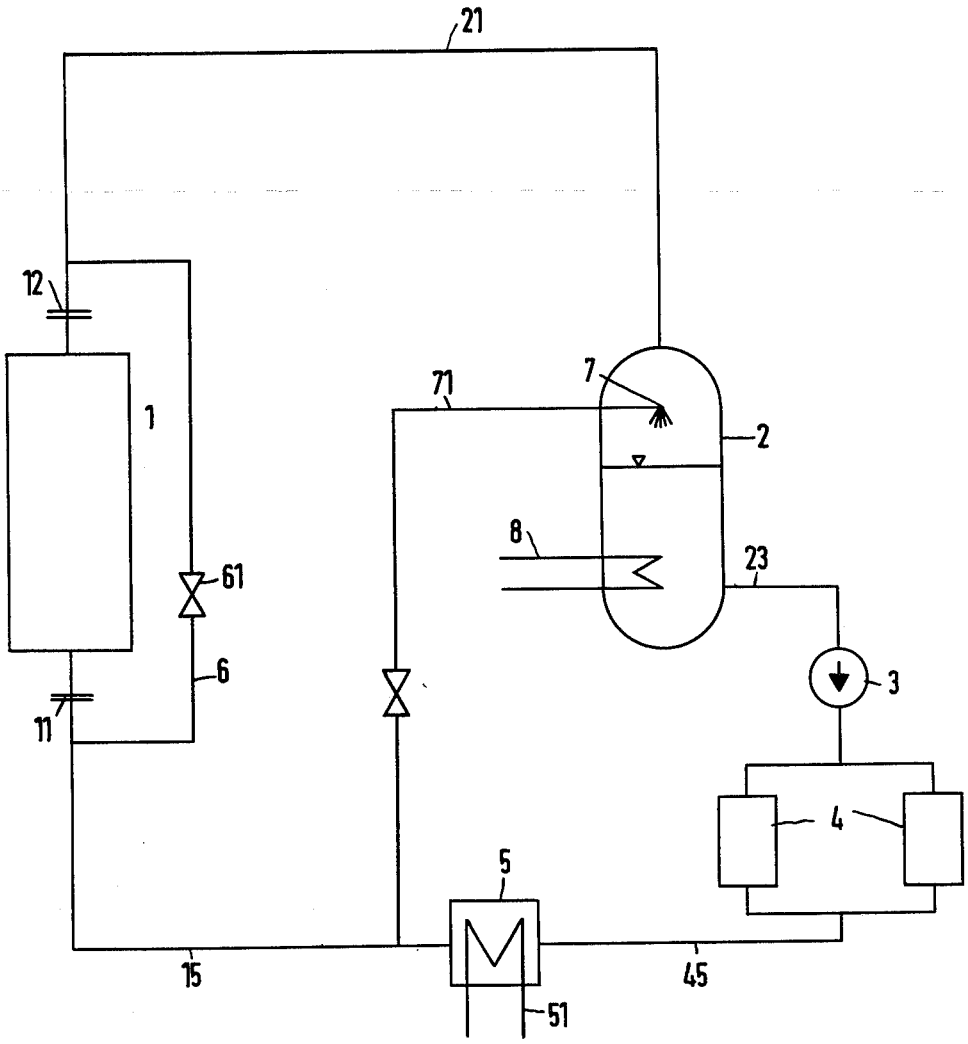
21
12
1
61
6
11
71
7
2
8
23
3
4
5
15
45
51

COOLING SYSTEM FOR SHIPPING CASKS

The present invention relates to a cooling system for casks for transporting heat-emitting parts from nuclear installations, especially spent fuel assemblies. Spent fuel assemblies and products from nuclear power plants or reprocessing plants for nuclear materials, for example, develop heat and also are a source of radio-active radiation. For transporting such parts, special containers must therefore be provided which shield the environment against radiation from these substances and which are also suited to give off the heat emitted from the fuel assemblies etc., to the environment through radiation and convection.

It is necessary to cool such transport containers before they are unloaded. This has heretofore been done by spraying with cold water. It is, however, a disadvantage of this method that the occurrence of thermal shock stresses in the transport container, and in fuel assemblies contained therein, cannot be avoided.

It is accordingly an object of the invention to provide a cooling system for shipping casks which overcomes the hereinaforementioned disadvantages of the heretofore known devices of this general type and which include a closed cooling loop which can be easily controlled and with which it is possible to avoid thermal shock stresses of the kind mentioned above.

With the foregoing and other objects in view, there is provided, in accordance with the invention, a cooling system for containers for transporting heat-emitting parts from nuclear installations comprising a closed loop connected to the container for carrying water/-steam or water, the loop having disposed therein a heatable mixing condenser, a conventional filter installation, a cooler, a pump and valve-control means for controlling pressure and temperature in the loop.

In accordance with a further feature of the invention, there are provided flexible joints connecting the loop to the container.

In accordance with another feature of the invention, there are provided an internal water spraying device disposed in the mixing condenser and means for supplying water to the spraying device from the closed loop.

In accordance with a concomitant feature of the invention, there are provided means for selectively directing the water/steam or water in a path through the container and part of the loop, and in another path exclusively through the loop, bypassing the container.

Other features which are considered as characteristic for the invention are set forth in the appended claims.

Although the invention is illustrated and described herein as embodied in cooling system for shipping casks, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single FIGURE of the drawing which is a schematic diagram of an embodiment of the drawing.

Referring now to the FIGURE of the drawing, there is seen a transport container or shipping cask designated with reference numeral 1. The cask 1 is connected to the rest of the system by flexible couplings or joints 11 and 12. From the coupling 12, a connecting line 21 leads to a mixing condenser 2, which is equipped with a heating device 8. The mixing condenser 2, furthermore, contains a spraying device 7 which is connected to a loop line 15 through a line 71. The condensate produced in the mixing condenser 2 flows through the line 23 to the pump 3 and from there, through filters 4 and a line 45, into a cooler 5. The cooler 5 is provided with a secondary cooling system 51 and its outlet is connected through the loop line 15 to the coupling 11 at the shipping cask 1. The loop lines 21 and 15 are, furthermore, directly connected to one another through a bypass line 6, into which a valve 61 is inserted.

When the cooling system is first used, it is heated up by the heater 8 in order to avoid thermal stresses, and the loop is initially closed through the bypass line 6 and the opened valve 61. The preheating is carried to a temperature which is about 50° C. lower than the prevailing inside wall temperature of the cask 1. Subsequently, the shipping cask 1 is inserted into the cooling system by means of the flexible connections or couplings 11 and 12 and the valve 61 is closed fully or partly.

If the shipping cask is a so-called "dry container", in which the empty container volume is filled with air, the heat stored in the container and the fuel assemblies as well as the decay heat are removed by injecting preheated water supplied by means of the pump 3. The water evaporating in the cask 1 flows through the line 21 into the mixing condenser 2 where it is condensed by injection of water from the spraying device 7. The condensate is then transported again through the pump 3 to the filter installation 4 and subsequently into the cooler 5. In the cooler 5, the heat taken from the shipping cask is removed from the water by a secondary coolant system 51. The filter installation 4 is constructed in a known manner of mechanical and/or ion exchange filters and serves the purpose of purifying the loop water by removing contamination, especially radioactive contamination. The pressure control necessary for the injection of the water into the shipping cask 1 is accomplished by condensation of the quantity of steam in the tank 2.

Following the evaporation phase in the shipping cask 1, the remaining stored container-heat and the decay-heat, respectively, are removed by normal introduction of undercooled or supercooled water from the line 15 by means of the circulating pump 3; depending on the materials to be cooled, under certain conditions, a temperature difference between the inlet and outlet lines 15 and 21, respectively, can be controlled. In that case, water injection into the mixing condenser through the line 71 is no longer necessary.

This mode of operation is also suitable for so-called "wet containers" i.e. for shipping casks in which the empty container volume is at least partly filled with water.

The gases flushed from the container 1 into the mixing condenser 2, such as fission gases from defective fuel rods, can be conducted to an exhaust gas system in a conventional manner which is not illustrated.

The system, furthermore, contains the necessary filling, draining and cleaning connections, as well as appropriate control devices. These are not specifically shown for the sake of clarity, especially since they are not directly related to the essence of the present invention and are not necessary for a complete understanding thereof.

The description shows how it is possible, in a simple manner, to reliably avoid thermal shock stresses which may occur in the shipping cask. The two modes of operation, such as evaporation and wet cooling, merge therein, so that special monitoring devices with respect to the water phase are not necessary.

In all variants of this cooling system, a completely closed coolant loop is ensured, so that contamination of the environment by possibly flushed-out fission products can be precluded with certainty.

There are claimed:

1. Cooling system having a container for transporting heat-emitting parts without temperature shock after removal from nuclear installations, comprising a closed loop for carrying water and steam or water alone, and means for connecting the container to said loop, said loop having disposed therein a heatable mixing condenser for regulating pressure and temperature in said loop, a filter installation for removing possible radioactive contamination from the water, a cooler for cooling water in said loop, a pump, and valve-control means for controlling pressure and temperature in said loop.

2. Cooling system according to claim 1, including joints connecting said loop to the container.

3. Cooling system according to claim 1, including an internal water spraying device disposed in said mixing condenser and means for supplying water to said spraying device from said closed loop.

4. Cooling system according to claim 1, including means for selectively directing the water and steam or water alone in a path through the container and part of said loop, and in another path exclusively through said loop bypassing the container.

* * * * *